US010759596B2

(12) United States Patent
Voong et al.

(10) Patent No.: US 10,759,596 B2
(45) Date of Patent: Sep. 1, 2020

(54) CARGO CONTAINER WITH DUAL MODE DOORS

(71) Applicant: Satco, Inc., El Segundo, CA (US)

(72) Inventors: Vince Voong, El Segundo, CA (US); Tom Gahan, El Segundo, CA (US)

(73) Assignee: SATCO, INC., El Segundo, CA (US)

( * ) Notice: Subject to any disclaimer, the term of this patent is extended or adjusted under 35 U.S.C. 154(b) by 85 days.

(21) Appl. No.: 16/197,012

(22) Filed: Nov. 20, 2018

(65) Prior Publication Data

US 2020/0156864 A1 May 21, 2020

(51) Int. Cl.
*B65D 88/14* (2006.01)
*B65D 90/00* (2006.01)

(52) U.S. Cl.
CPC ..... *B65D 90/0086* (2013.01); *B65D 88/14* (2013.01); *B65D 2590/547* (2013.01)

(58) Field of Classification Search
CPC .. B65D 90/0086; B65D 88/14; B65D 88/127; B65D 88/121
USPC ..... 220/1.5
See application file for complete search history.

(56) References Cited

U.S. PATENT DOCUMENTS

| | | | | |
|---|---|---|---|---|
| 3,904,064 | A | 9/1975 | Looker | |
| 4,538,663 | A | 9/1985 | Looker | |
| 5,377,856 | A | 1/1995 | Brierton | |
| 8,479,801 | B2 | 7/2013 | Holland et al. | |
| 2014/0183187 | A1* | 7/2014 | Nemoto | B65D 88/127 220/1.5 |
| 2015/0104287 | A1* | 4/2015 | Ryan | B65D 90/0033 414/800 |

FOREIGN PATENT DOCUMENTS

| | | | |
|---|---|---|---|
| EP | 1528012 | A1 | 5/2005 |
| EP | 2409934 | A1 | 1/2012 |
| JP | 2012121625 | A | 6/2012 |

* cited by examiner

*Primary Examiner* — Stephen J Castellano
(74) *Attorney, Agent, or Firm* — Perkins Coie LLP; Kenneth H. Ohriner

(57) ABSTRACT

A cargo container includes a base, side walls and a rear wall on the base and a top attached to the side walls and the rear wall. A front frame is attached to the base, the side walls and the top. Left and right swing out doors are pivotally attached to the left and right sides of the front frame. A roll up door is attached to a top of the front frame, in between the left and right swing out doors. The container may be loaded and unloaded with the swing out doors and the roll up door open, providing a maximum size front opening, or with the swing out doors closed and the roll up door open, providing a reduced size front opening equal to the width of the roll up door.

20 Claims, 5 Drawing Sheets

CARGO CONTAINER WITH DUAL MODE DOORS

BACKGROUND OF THE INVENTION

Air cargo containers have been used for the transportation of cargo by aircraft for many years. Cargo such as cartons, smaller shipping containers, etc. is first loaded into a container. The container is then loaded into an aircraft. Use of air cargo containers is faster than loading cargo directly into the cargo space of the aircraft, since the individual cartons need not be separately placed and secured within the aircraft. The air cargo container can also be loaded at locations remote from the airport. Furthermore, because the cargo container is typically designed to fit the interior dimensions of specific aircraft, the container fits more securely in the cargo space and does not shift during flight. These and other advantages of air cargo containers have made air cargo containers widely used in the air freight and airline industry.

A typical air cargo container includes a base such as a flat square or rectangular aluminum pallet. Many air cargo containers have a roll up fabric or curtain door which may be opened or rolled up for loading and unloading the container. The fabric door is then closed or rolled down and secured with straps or other fittings, or via a rigid metal door bar at the bottom of the fabric door latched onto the base of the container. In some air cargo container designs, however, the width of the fabric door is limited do the container shape or other factors. This limits the width of the container opening.

Other types of cargo container have swing out doors. While these may have structural advantages, they are heavier than a roll up door. Typically, these types of containers have opposing left and right side swing out doors which entirely close off the container opening when the doors are moved into the closed position.

While these designs have performed well in the past, they may have the disadvantages discussed above, as well as other drawbacks. Accordingly, engineering challenges remain in designing an improved air cargo container.

SUMMARY OF THE INVENTION

In one aspect, a cargo container includes a base, side walls and a rear wall on the base and a top attached to the side walls and the rear wall. A front of door frame is typically attached to the base, the side walls and the top. A swing out door is pivotally attached to a side of the front frame, and a roll up door attached to a top of the front frame. The swing out door closes off a first portion of a front opening of the container when the swing out door is in a closed position. The roll up door closes off a second portion of the front opening when the roll up door is in a closed position. The container therefore may be loaded and unloaded using only the second portion of the front opening, or using the entire front opening. A retainer may be pivotally attached to a first side of the swing out door, with the retainer retaining a first side of the roll up door when the roll up door is in a closed position.

In another embodiment, the container has a two swing out doors on opposite sides of a roll up door. In this design a left swing out door is pivotally attached to a left side of the door frame and a right swing out door is pivotally attached to a right side of the door frame. The roll up door is attached to a top of the door frame, in between the left swing out door and the right swing out door.

The door frame may optionally include a footer beam with the roll up door having a door bar attachable to the footer beam when the roll up door is in the closed position. One or more locking or latching devices may be provided on the swing out door, with the locking or latching devices engageable with the footer beam for locking the swing out door into the closed position.

Other features and advantages will become apparent to persons skilled in the art from the following detailed description, which is provided as an explanation of the invention and is not intended to limit the scope of the invention.

BRIEF DESCRIPTION OF THE DRAWINGS

In the drawings, the same element number indicates the same element in each of the views.

DETAILED DESCRIPTION OF THE DRAWINGS

Figure 1:
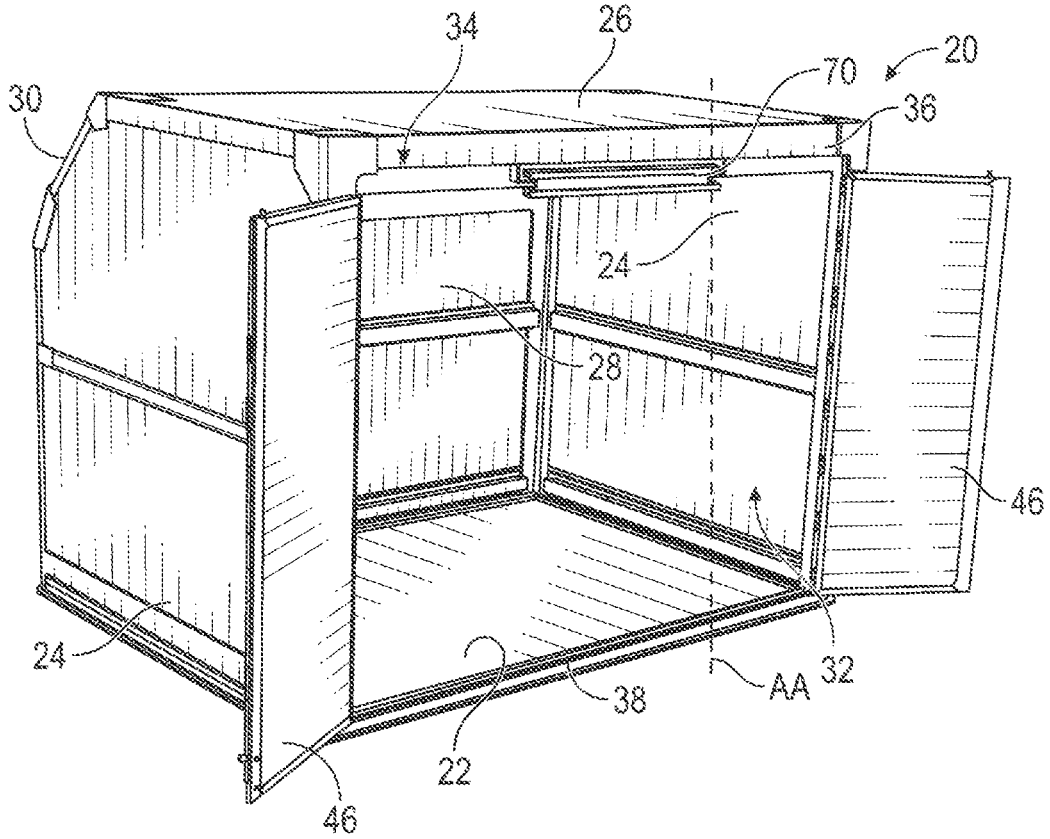
FIG. 1 is a perspective view of a new air cargo container.

As shown in FIG. 1, a cargo container 20 has a top 26 attached to side walls 24 and a rear wall 28, with the side walls 24 and rear wall 28 attached to a base 22. FIG. 1 shows an embodiment having straight and parallel side walls 24 and an angled rear wall section 30. FIGS. 2-5 show an embodiment having curved converging side walls 24 and a rear wall 28 with a curved upper section. The invention may used on these and other containers of various shapes and sizes.

Figure 2:
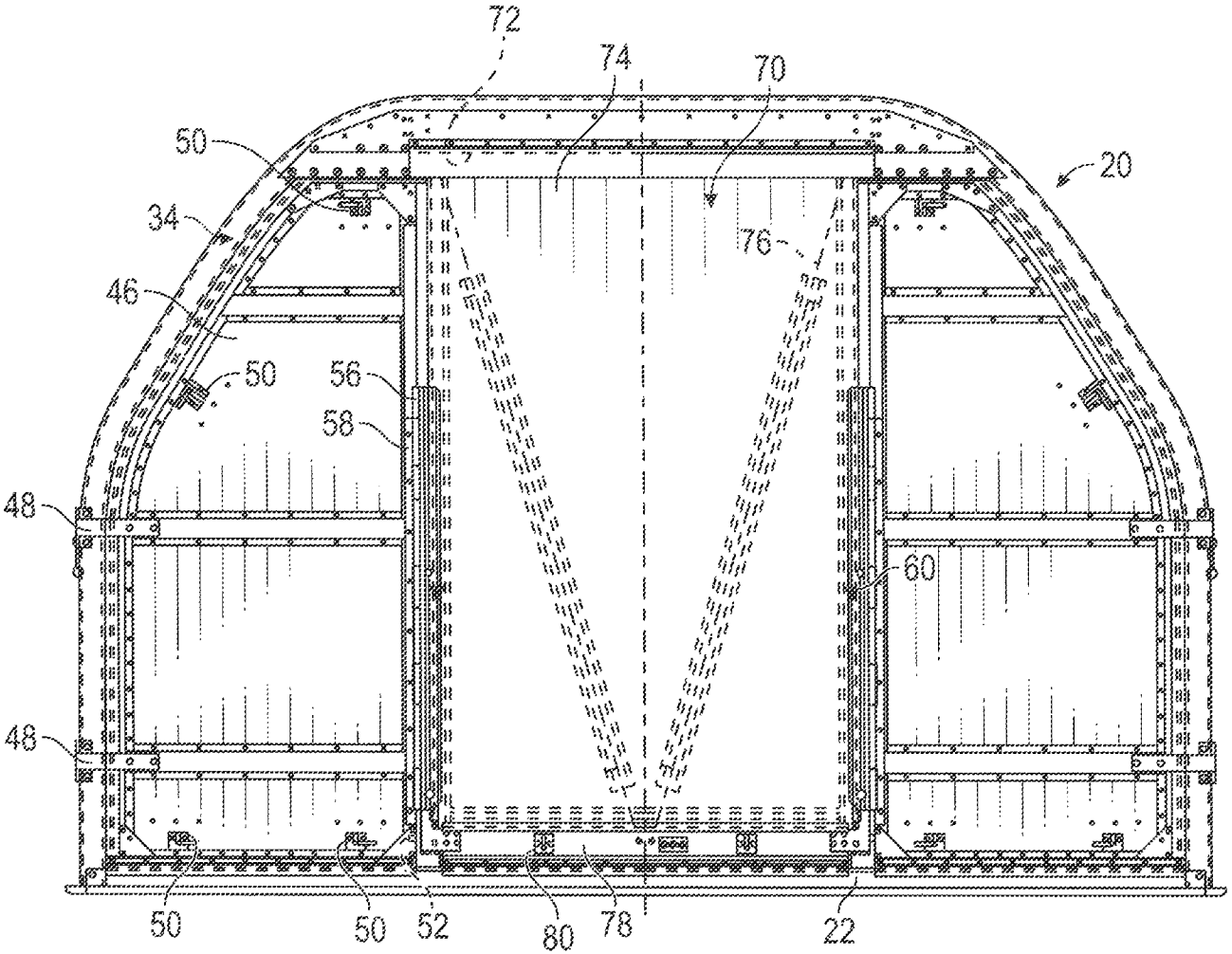
FIG. 2 is a front view of an air cargo container in a fully closed position, wherein the swing out doors and the roll up door are closed.

Referring still to FIG. 1, the container 20 has a front opening 32 formed within a front frame 34. The front frame 34 may include a header beam 36 and a footer beam 38. As shown in FIGS. 1 and 2, first and second (or left and right) swing out doors 46 are pivotally attached to the left and right sides, respectively, of the front frame 34 by hinges 48. Typically one or more locking or latching devices 50 are provided on each swing out door 46 to securely lock or latch the doors 46 into a closed position. The locking or latching devices 50 may include a lever-operated pin movable into a header receptacle 40 in the header beam 36 or into a footer receptacle 42 in the footer beam 38.

Figure 6:
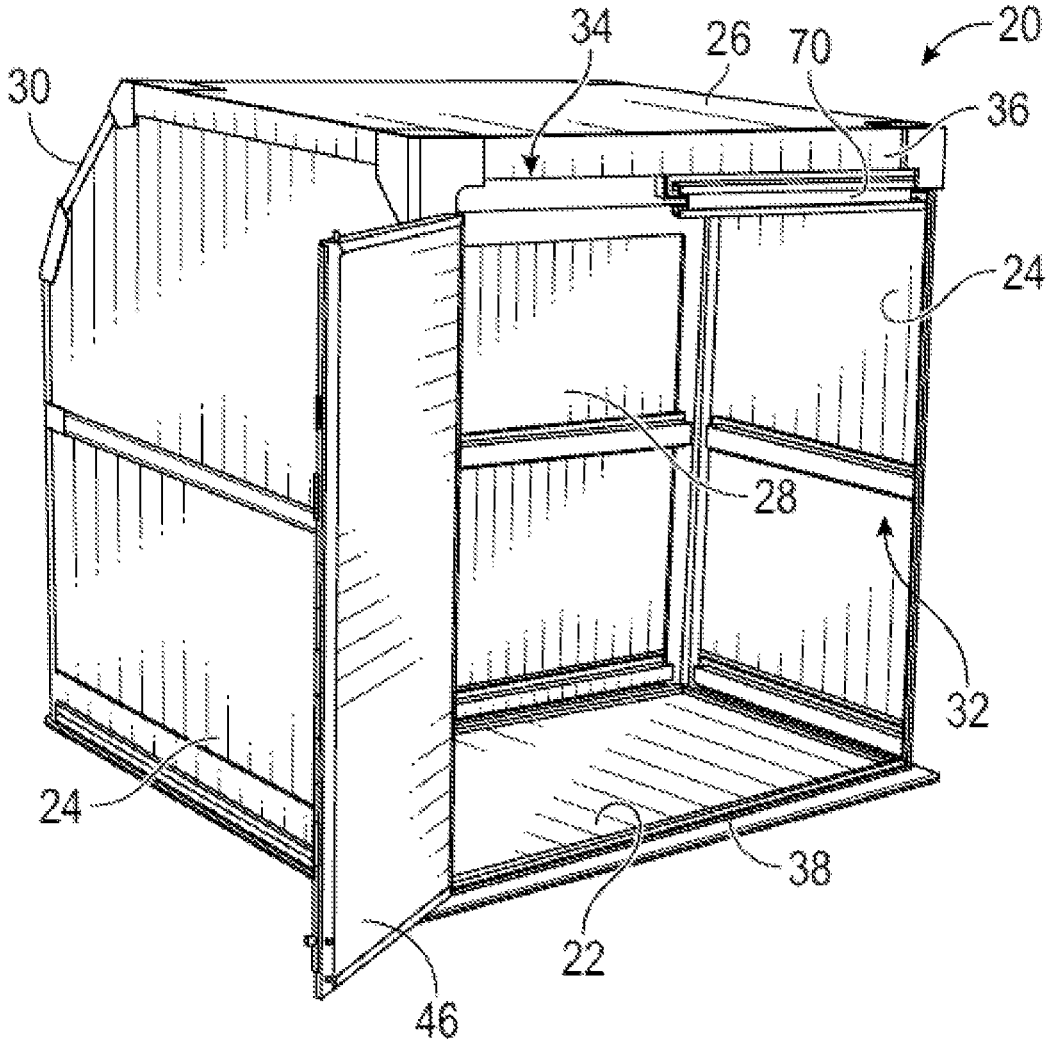
FIG. 6 is a perspective view of an alternative embodiment.

A roll up door 70 is located at the top of the front frame 34. The roll up door 70 typically includes a flexible curtain 74 wound on a roller 72. One or more cables 76 may be sewn onto the flexible curtain 74. A rigid door bar 78 may be attached at the lower end of the flexible curtain 74. In FIGS. 1 and 2 the roll up door 70 is centered in the front opening 32, and the left and right swing out doors 46 are symmetrical, or mirror images of each other. However, in alternative designs, the roll up door 70 may be offset to one side and the swing out doors 46 may have different widths. Containers with a single swing out door 46 on one side of the front frame 34 and a roll up door on the other side of the front frame 34, may also be used, as shown in FIG. 6. In this design the right side of the front frame ends at the dotted line AA in FIG. 1.

FIG. 1 shows the container 20 in a fully open position. The swing out doors 46 are open and the roll up door 70 is up or open, providing a maximum size of the front opening 32 of the container 20. FIG. 2 shows the container 20 in a closed position, with the swing out doors 46 closed and the roll up door 70 down or closed. As shown in FIG. 2, left and right retainers 56 may be attached at the inner edge of the swing out doors 46 via a retainer hinge 58. The retainers 56 can pivot from an open position, shown in FIG. 3, to a closed position, shown in FIG. 2. In the closed position the retainers 56 largely prevent the sides of the roll up door 70 from bulging outward. Each retainer 56 has a retainer latch 60 for securing the retainer 56 into the closed position shown in FIG. 2. Door jamb posts 52 may project inwardly from each swing out door 46, with the roll up door 70 engaging the door jamb posts 52 when in the down or closed position. One or more bar locking devices 80 may be provided on the door bar 78 to attach the door bar 78 onto the footer beam 38 or other structure, when the roll up door 70 is in the down or closed position.

Figure 3:
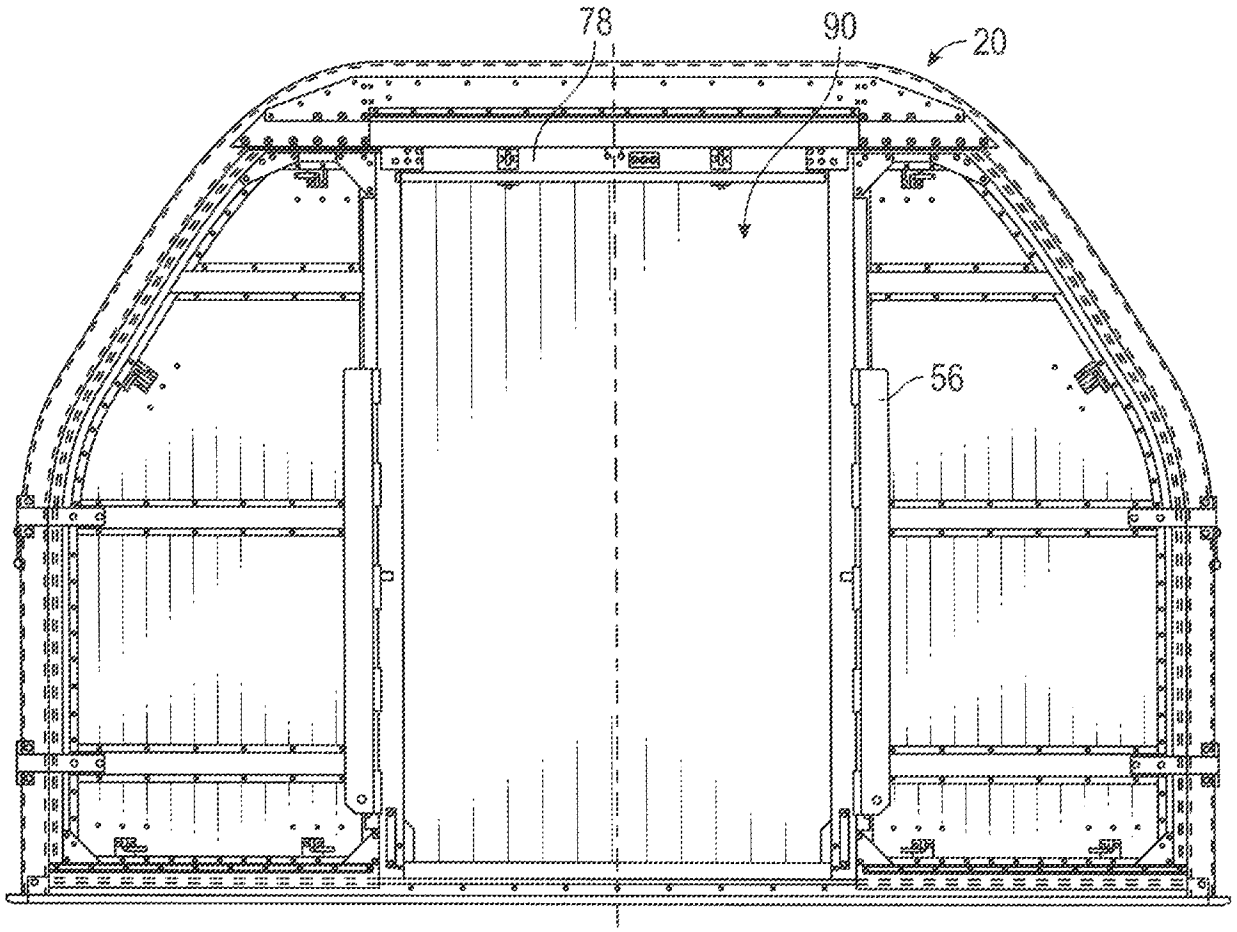
FIG. 3 is a front view of the air cargo container of FIG. 2 in a partially open position, wherein the swing out doors are closed and the roll up door is open.
Figure 4:
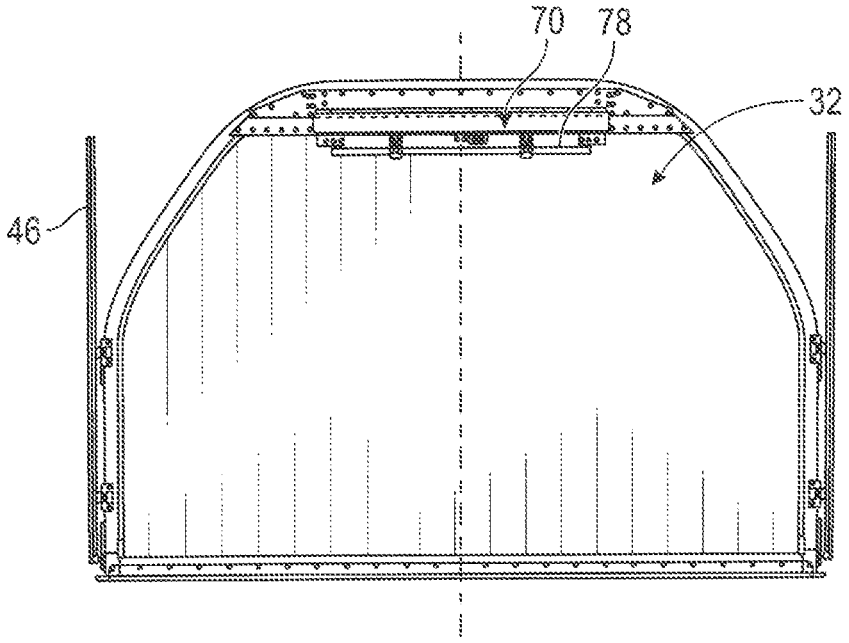
FIG. 4 is a front view of the air cargo container of FIGS. 2 and 3 in a fully open position, wherein the swing out doors are open and the roll up is open.
Figure 5:
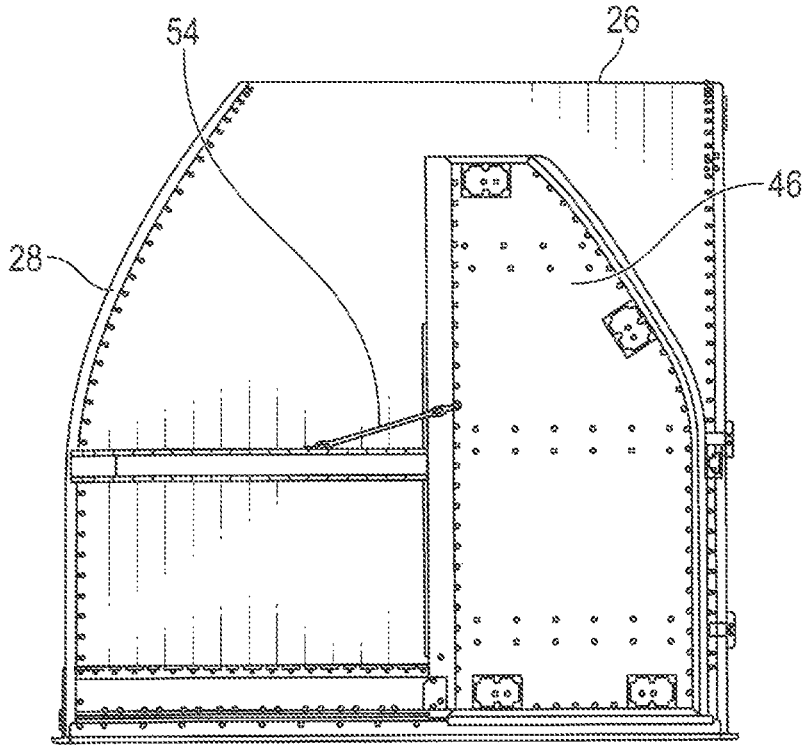
FIG. 5 is a side view of the air cargo container of FIG. 4 showing the left side door tethered into the open position.

FIG. 4 shows the container 20 of FIGS. 2 and 3 in the fully open position. The roll up door 70 is up and the swing out doors 46 are pivoted open, providing a maximum size front opening 32. As shown in FIG. 5, the swing out doors 46 may be secured into the open position by a tether or latch 54. Loading and unloading the container 20 in the fully open position may be preferred when moving large or long cargo into and out of the container, or when more than one person is doing the loading or unloading.

FIG. 3 shows the container 20 with the swing out doors 46 closed and with the roll up door 70 up or open. The roll up door opening 90, in the example of FIG. 3, is about the same width as the swing out doors 46. However, the width of the roll up door 70, which determines the width of the roll up door opening 90, may vary depending on intended use of the container 20. Loading and unloading the container 20 using only the roll up door opening 90 (with the swing out doors 46 closed) may be preferred when loading smaller cargo, with the closed swing out doors 46 helping to retain the cargo in place during the loading and unloading.

The principles of the invention as described above may be used on air cargo containers of various shapes, sizes and configurations of so-called unit load devices (ULD's) as described in the specifications of the International Air Transport Association. References here to top, side walls and rear wall are to the general area or surfaces of the containers, as in containers with curved surfaces may not reveal strict delineations between these elements. Correspondingly, the term top, side wall or rear wall may also collectively designate two or more surfaces. The principles of the invention may also be used in cargo containers primarily or exclusively intended for ground transportation. The design and manufacturing details described in U.S. Pat. No. 4,538,663, incorporated herein by reference, may be used in the cargo containers described above.

Thus, novel containers have been shown and described. Various changes and substitutions may of course be made, without departing from the spirit and scope of the invention. The invention, therefore, should not be limited, except by the following claims and their equivalents.

The invention claimed is:

1. A cargo container, comprising:

a base, side walls on the base, and a top attached to the side walls and to a door frame;

a swing out door having a first side pivotally attached to a first side of the door frame;

a roll up door attached to a top of the door frame; and a retainer pivotally attached to a second side of the swing out door, with the retainer retaining a first side of the roll up door when the roll up door is in a closed position.

2. A cargo container, comprising:

a base, side walls on the base, and a top attached to the side walls;

a door frame attached to the base;

a swing out door pivotally attached to a side of the door frame;

a roll up door at a top of the door frame;

a retainer on the swing out door, the retainer movable to retain one side of the roll up door;

the container having a single front opening, the swing out door closing off a first portion of the single front opening when the swing out door is in a closed position, and the roll up door closing off a second portion of the single front opening when the roll up door is in a closed position, the first portion and the second portion together forming the entire single front opening.

3. The cargo container of claim 1 with the swing out door pivotally attached to a first side of the door frame and with the roll up door attached to the top of the door frame at a second side of the door frame.

4. The container of claim 2 wherein the roll up door comprises a flexible curtain having one or more cables, and the flexible curtain is wound on a roller.

5. An air cargo container, comprising:

a base, first and second side walls attached onto opposite sides of the base, and a top attached to the first and second side walls;

a front frame attached to the first and second side walls and to the base;

a front opening within the front frame;

a first side of a first swing out door pivotally attached to a first side of the front frame;

a second swing out door pivotally attached to a second side of the front frame;

a roll up door including a flexible curtain having one or more cables, the flexible curtain wound on a roller, the roll up door in between the first swing out door and the second swing out door;

a retainer on a second side of the first swing out door, the retainer movable to retain one side of the roll up door;

the first swing out door, the second swing out door and the roll up door closing off the front opening.

6. The air cargo container of claim 5 with the roller supported at a top of the front frame.

7. The air cargo container of claim 5 wherein the roll up door has a width greater than the first swing out door, and greater than the second swing out door.

8. The container of claim 5 with the front frame including a footer beam and the roll up door having a door bar attachable to the footer beam when the roll up door is in a closed position, at least one locking device on each of the first and the second swing out doors engageable with the footer beam for locking the first and second swing out doors, respectively, into a closed position.

9. The container of claim 5 further including a retainer latch for securing the retainer into a closed position.

10. A cargo container, comprising:

a base, side walls and a rear wall on the base and a top attached to the side and rear walls;

a front frame attached to the base;

a left swing out door pivotally attached to a left side of the front frame;

a right swing out door pivotally attached to a right side of the front frame;

a roll up door attached to a top of the front frame, in between the left swing out door and the right swing out door;

the roll up door having a width greater than the left swing out door, and greater than the right swing out door;

the container having a single front opening, the left and right swing out doors closing off first and second portions of the single front opening when the left and right swing out doors are in a closed position, and the roll up door closing off a third portion of the single front opening when the roll up door is in a closed position, the first portion, the second portion and the third portion together forming the entire single front opening.

11. The container of claim 10 with the front frame including a footer beam and the roll up door having a door bar attachable to the footer beam when the roll up door is in a closed position, at least one locking device on each of the left and right swing out doors engageable with the footer beam for locking the left and right doors into a closed position.

12. The container of claim 10 wherein the roll up door comprises a flexible curtain wound on a roller, and one or more cables sewn onto the flexible curtain.

13. The container of claim 10 with the roll up door having a door bar engageable with the left swing out door and the right swing out door.

14. The container of claim 10 further comprising a left retainer attached to a right side of the left swing out door, and a right retainer attached to a left side of the right swing out door, with the left and right retainers each movable from an open position into a closed position to retain the roll up door.

15. The container of claim 14 further comprising left and right retainer latches for latching the left and right retainers into the closed positions.

16. The container of claim 10 further comprising a left retainer on the left swing out door, and a right retainer on the right swing out door, with the left and right retainers each movable towards a centerline of the container, from an open position to a closed position, to prevent sides of the roll up door from bulging outward.

17. The container of claim 10 with the roll up door centered in the front frame.

18. The container of claim 10 with the left swing out door having a width equal to the right swing out door.

19. An air cargo container, comprising:

a base, side walls on the base and a top attached to the side walls;

a front frame attached to the base, the front frame having a header beam and a footer beam;

a left swing out door pivotally attached to a left side of the front frame;

a right swing out door pivotally attached to a right side of the front frame;

a roll up door attached to a top of the front frame, in between the left swing out and the right swing out door, the roll up door having a door bar attachable to the footer beam when the roll up door is in a closed position;

at least one locking device on each of left and right swing out doors engageable with the footer beam for locking the left and right swing out doors into a closed position;

a left retainer attached to a right side of the left swing out door, and a right retainer attached to a left side of the right swing out door, with the left and right retainers movable into closed positions to retain the roll up door;

the container having a single front opening which is partially closed off when the left and right swing out doors are in a closed position and the roll up door is an open position, and with the single front opening entirely closed off when the left and right swing out doors are in the closed position and the roll up door is the closed position.

20. The container of claim 19 wherein the container is symmetrical about its centerline.

* * * * *